US005141469A

United States Patent [19]

Satake et al.

[11] Patent Number: 5,141,469

[45] Date of Patent: Aug. 25, 1992

[54] TOY RACING SET

[75] Inventors: Isao Satake, Kyoto; Mitsuru Okano, Kanagawa, both of Japan

[73] Assignee: Kyosho Corporation, Tokyo, Japan

[21] Appl. No.: 645,894

[22] Filed: Jan. 25, 1991

[30] Foreign Application Priority Data

Jun. 28, 1990 [JP] Japan ..... 2-68810
Jun. 28, 1990 [JP] Japan ..... 2-68811

[51] Int. Cl.[5] ..... A63H 18/00
[52] U.S. Cl. ..... 446/446; 446/431
[58] Field of Search ..... 446/431, 441, 444, 445, 446/446, 447

[56] References Cited

U.S. PATENT DOCUMENTS

| | | | |
|---|---|---|---|
| 2,537,281 | 1/1951 | Roshak | 446/431 X |
| 3,447,257 | 6/1969 | Ieda | 446/446 |
| 3,466,043 | 9/1969 | McRoskey et al. | 446/446 X |
| 4,147,351 | 4/1979 | Saito | 446/441 X |
| 4,156,987 | 6/1979 | Lahr | 446/444 |
| 4,382,599 | 5/1983 | Tilbor | 446/444 X |

FOREIGN PATENT DOCUMENTS

| | | | |
|---|---|---|---|
| 253297 | 1/1988 | European Pat. Off. | 446/444 |

*Primary Examiner*—Robert A. Hafer
*Assistant Examiner*—Sam Rimell
*Attorney, Agent, or Firm*—Nixon & Vanderhye

[57] ABSTRACT

A toy racing set includes an endless track and a remote-controlled self-propelled wireless racing toy adapted to travel around the track in a predetermined direction. The track includes a number of curved and straight sections connected to one another in such a manner as to establish a desired closed-loop race course. The straight sections of the track have a plurality of linear grooves extending generally parallel to the travel direction of the racing toy. The curved sections have a plurality of discontinuous turning grooves which are oriented at an angle from an outside portion of the curved section towards an inside portion of the curved section with respect to the predetermined travel direction of the racing toy as the racing toy enters the curved section from an adjacent straight section. The racing toy is of the single-channel variety (i.e., having only speed control available through the remote control unit) and is provided with a pair of wheels which are steerably turnable by a downwardly extending guide brush. The guide brush is adapted to being guided within one of the grooves in the track as the racing toy travels around the track. In this regard, frictional engagement between the brush and the angled turning grooves varies in response to speed of the racing toy. Therefore, at a relatively high speed of travel, the brush slides over the discontinuous angled turning grooves whereby no turning movement is imparted to the racing toy, but at relatively low speed of travel the brush is engaged within and follows one of the angled turning grooves whereby turning movement is imparted to the racing toy.

17 Claims, 5 Drawing Sheets

TOY RACING SET

FIELD OF INVENTION

The present invention relates to a remote-control racing toy which follows a race course by means of drive wheels being controlled by grooves formed in the race track which defines the course.

BACKGROUND OF THE INVENTION

Racing toys may be classified by two types—those which are controlled by means of wires, and those which are remote-controlled. In the case of wire-controlled racing toys, electrically conductive pick-up rails are typically associated with a groove which is formed in the racing track. Wire-controlled racing toys are thus operated somewhat passively since the racing toy is physically guided by the groove. The operator controls only the voltage that is applied to the pick-up rails which is supplied to the racing toy by means of a collector brush in contact with the pick-up rails. Remote-controlled racing toys, however, are not physically restrained by means of a groove. Thus, remote-controlled racing toys are operated in a more active manner, i.e., with the operator controlling backward and forward motions as well as steering the racing toy using a two-channel transceiver.

In racing toys which are guided by means of a groove, since the direction of travel cannot be controlled, a guide lever which controls the steering wheels is inserted into the guide groove that is formed in the racing course. The racing toy is thus made to travel such that the guide lever does not come out of the guide groove. Moreover, one guide groove is required for each racing toy. In other words, if there are three racing toys traveling on the course, three guide grooves are formed in the course to allow each of the racing toys to travel simultaneously around the course.

During actual automobile races, (which racing toys are supposed to emulate) when an automobile enters a curve, the driver controls the speed and/or direction of the automobile taking maximum advantage of the width of the track with respect to the radius and angle of the curve. The automobile should therefore enter the curve moving from the outside to the inside of the curve, maintain an inside path at the midpoint of the curve and finally approach a straight line of travel while moving towards the outside of the curve by accelerating just prior to leaving the curve (i.e, the "out-in-out" technique). As a result, the automobile can negotiate the curve at relatively high speed.

As can be appreciated, it is practically impossible for racing toys which employ a guide lever which is inserted into a guide groove to faithfully replicate the driving characteristics of actual automobiles. That is, since the operator can only exercise speed control over the racing toy and since the racing toy does not leave its assigned groove, the image and "feel" of such racing toys varies from that associated with actual automobile racing. This problem results in a considerably diminished level of interest and enjoyment in racing toys and games. On the other hand, in the case of racing toys which employ a two-channel remote control system, since both speed and direction of travel can be controlled as desired, the disadvantages associated with wire-controlled systems described above are overcome somewhat. However, remote-controlled systems typically have higher manufacturing costs due to the need for a two-channel transceiver and the complex structure of the racing toy thereby making the toys cost-prohibitive for some people.

SUMMARY OF THE INVENTION

In attempting to solve the problems noted above with respect to prior art racing toys, the present invention provides a racing toy which can be made to travel around curves on the racing course in a manner which more faithfully emulates actual automobile racing by simply controlling the toy's speed. Thus, despite the toy being a single-channel remote-controlled system in which only speed can be controlled, the toy is a better imitation of the "look and feel" of actual automobile racing.

The present invention also provides a racing track device for a racing toy in which the travel of the racing toy can be controlled on curves in the same manner as an actual automobile race. According to this aspect of the invention, a pattern of grooves are provided so as to guide a brush associated with the racing toy. Thus, by controlling the speed, a single-channel remote-controlled racing toy (i.e., one in which only speed can be controlled), control can be exercised over the racing toy's direction of travel. The present invention thus allows, for example, a racing toy to be guided into and out of a pit area adjacent to the course by simply controlling the speed of the racing toy on a straight portion of the course. In other words, the racing toy of the present invention is such that a brush, which controls a steering lever, is inserted into one of the guide grooves of a course in which a plurality of such guide grooves is formed. This makes it possible for the racing toy to travel following those grooves on the straight portions of the course, as well as traveling around the outside or inside of the curves in dependence upon the speed of the racing toy. The steering lever of the toy is controlled by means of frictional resistance between the irregular surfaces on the track and the toy's guide piece resulting from the presence of the grooves on curved portions of the track. In addition, a plurality of grooves in which the brush (which is attached to the steering lever of the racing toy) is guided are formed over the entire surface of the racing track.

Moreover, since the grooves are oriented relative to the curved track portions such that the grooves run from the outside to the inside of the curve, when the racing toy enters a curved portion from a straight portion of the race course, the grooves result in the brush being subjected to resistance which is dependent upon the speed of the racing toy. This speed-dependent resistance thus causes the racing toy to travel such that it is directed towards the inside of the curve due to the steering lever being controllably operated by means of the frictional resistance between the track and the guide brush associated with the racing toy. Moreover, since grooves at the entrance to a pit area are oriented towards the pit area on a straight portion of the course, the racing toy can be made to enter the pit area for a pit stop simply by reducing the speed of the racing toy.

BRIEF DESCRIPTION OF THE ACCOMPANYING DRAWINGS

Reference will hereinafter be made to the accompanying drawings wherein like reference numerals throughout the various FIGURES denote like structural elements, and wherein.

Figure 5A:
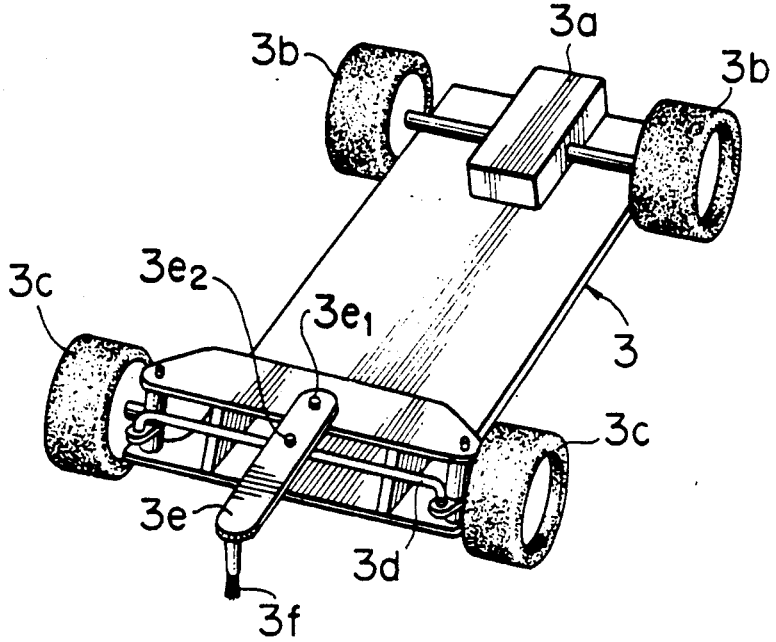
Figure 5B:
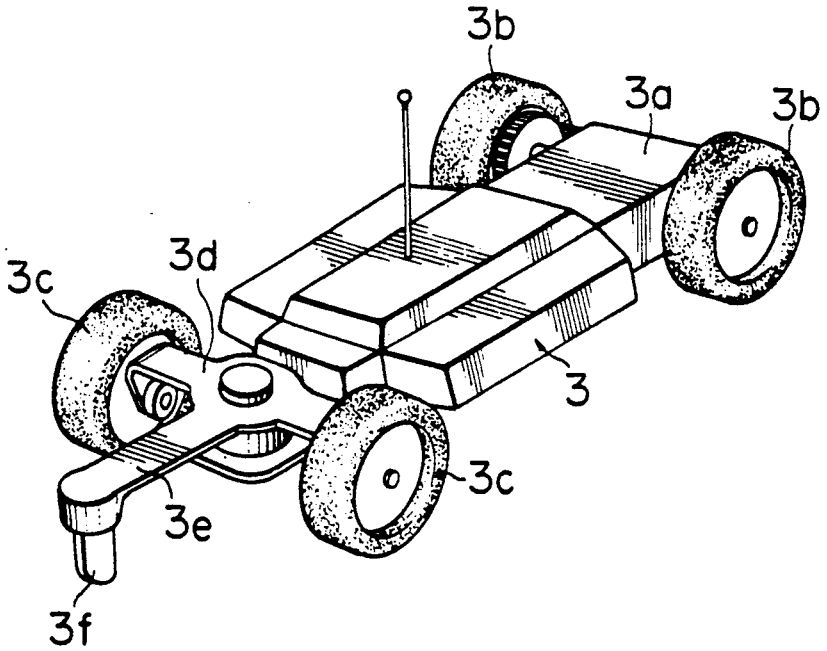
Figure 6:
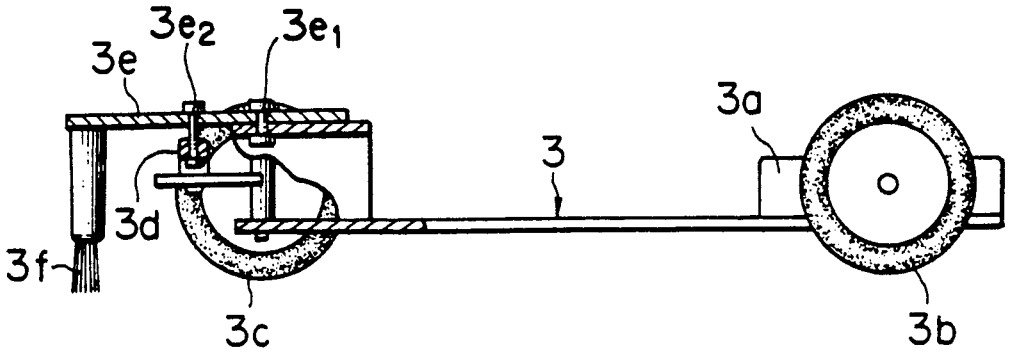
Figure 7:
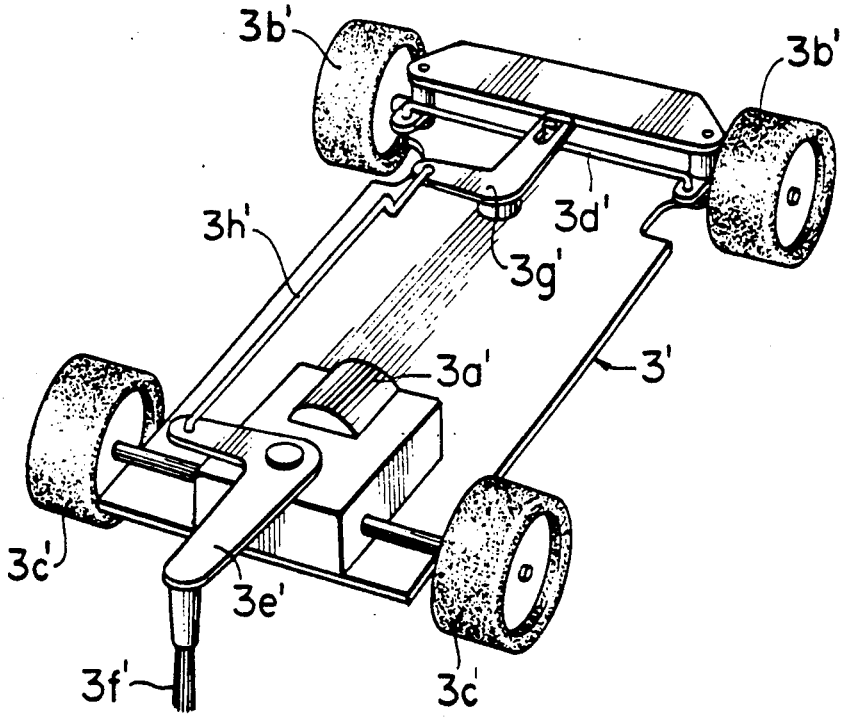

FIGS. 5*a* and 5*b* are each perspective views of a racing toy according to the present invention;

FIG. 6 is a side view of the racing toy shown in FIGS. 5*a* and 5*b* and,

FIG. 7 is a perspective view of a another embodiment of a racing toy according to the present invention.

DETAILED DESCRIPTION OF THE PRESENT INVENTION

Figure 1:
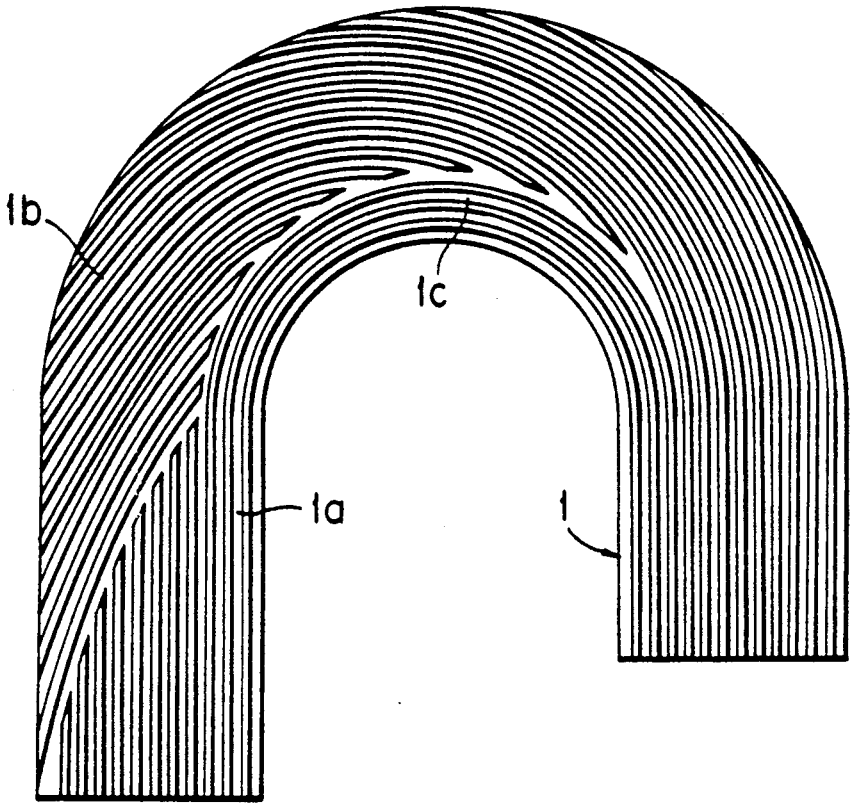
FIG. 1 is a top view of the race track upon which the racing toy of the present invention travels.
Figure 2:
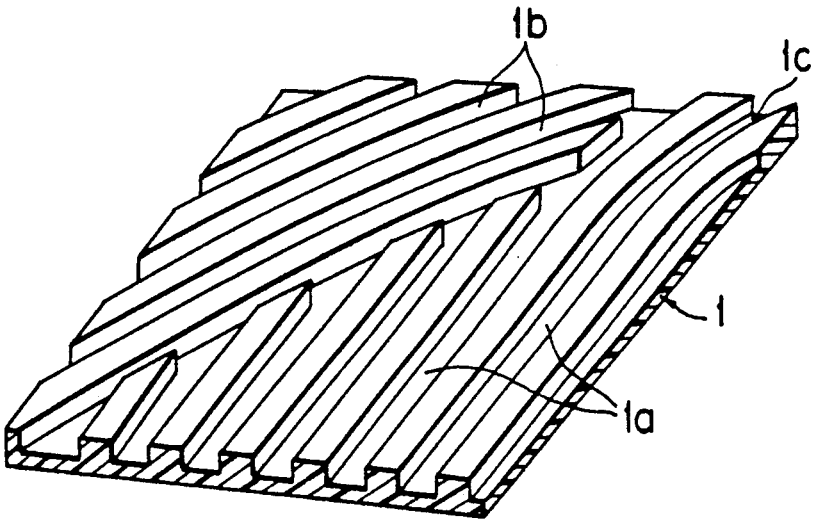
FIG. 2 is an enlarged perspective view of a portion of the race track shown in FIG. 1.
Figure 3:
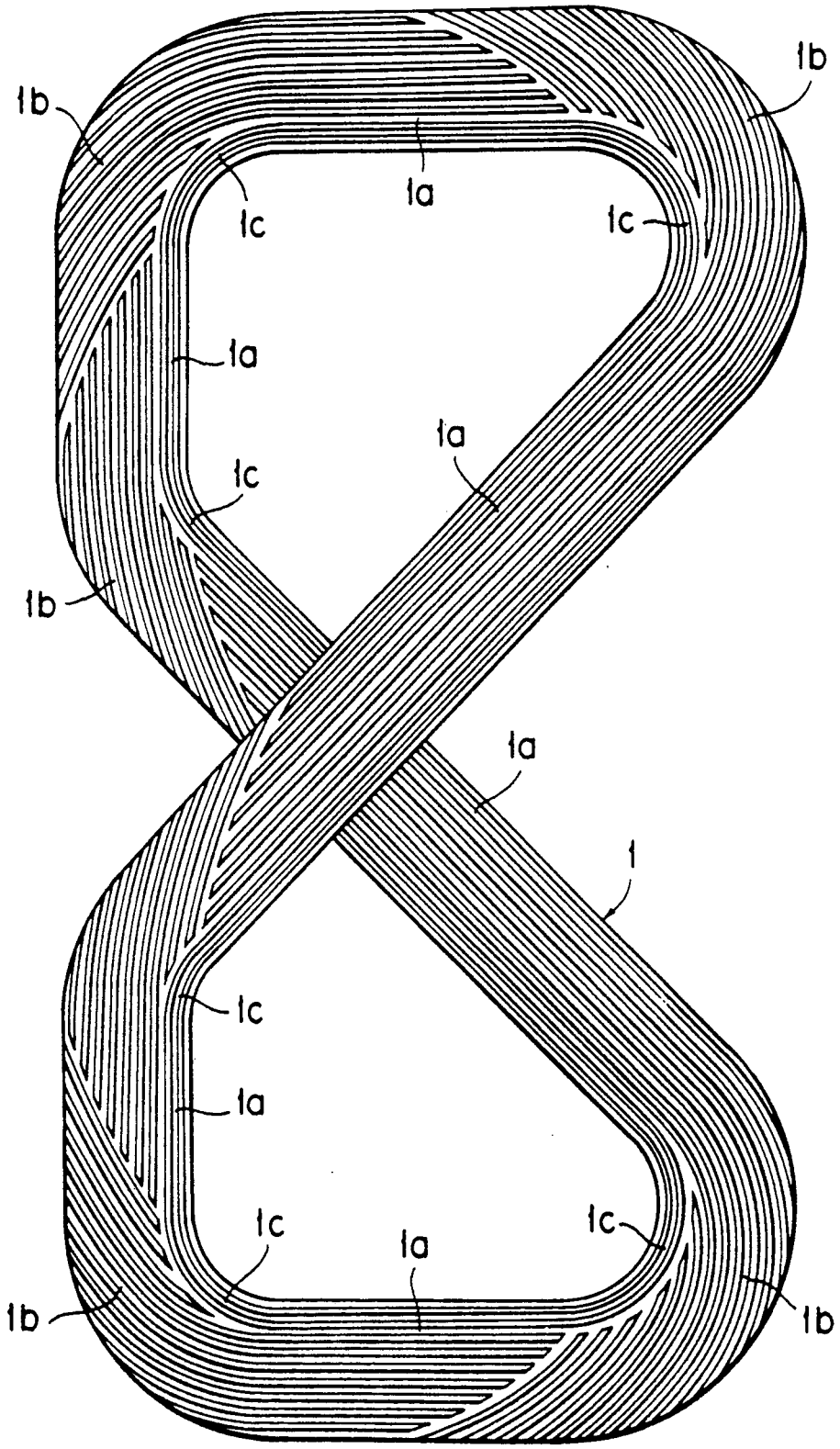
FIG. 3 is a top view of one possible race course.

The race track for allowing travel of the racing toy of the present invention will be described below with reference to the accompanying drawings. In this regard, FIGS. 1 through 3 depict one embodiment of a racing track according to the invention. The race track 1 is formed of a material, such as synthetic resin, which allows irregular surfaces to be formed easily therein. A plurality of grooves 1*a*–1*c* are thus formed over the entire width of either one side or both sides of the track 1 (one side in the case of the track 1 shown in the drawings). Straight grooves 1*a* are formed on straight portions of race track 1. Inclined grooves 1*b* are oriented in a direction towards the inside of the curve from a point just prior to the entrance of the curve to the midpoint of the curve and are then oriented parallel to the straight grooves 1*a* at the exit of the curves. Centrifugal grooves 1*c* having the same curvature as the curve are provided along the inside edges of the curve. The race track 1 may be fabricated to suitable lengths and types which may be combined to allow formation of various courses, such as those shown in FIG. 3 of FIG. 4.

Furthermore, although the race track shown in the accompanying drawings allows racing in which the racing toys travel the course in a right-hand (clockwise) manner, race tracks forming a course in which the racing toys travel in a left-hand (counter-clockwise) manner may be provided in which case the race tracks are a mirror image to those shown in the accompanying drawings.

Figure 4:
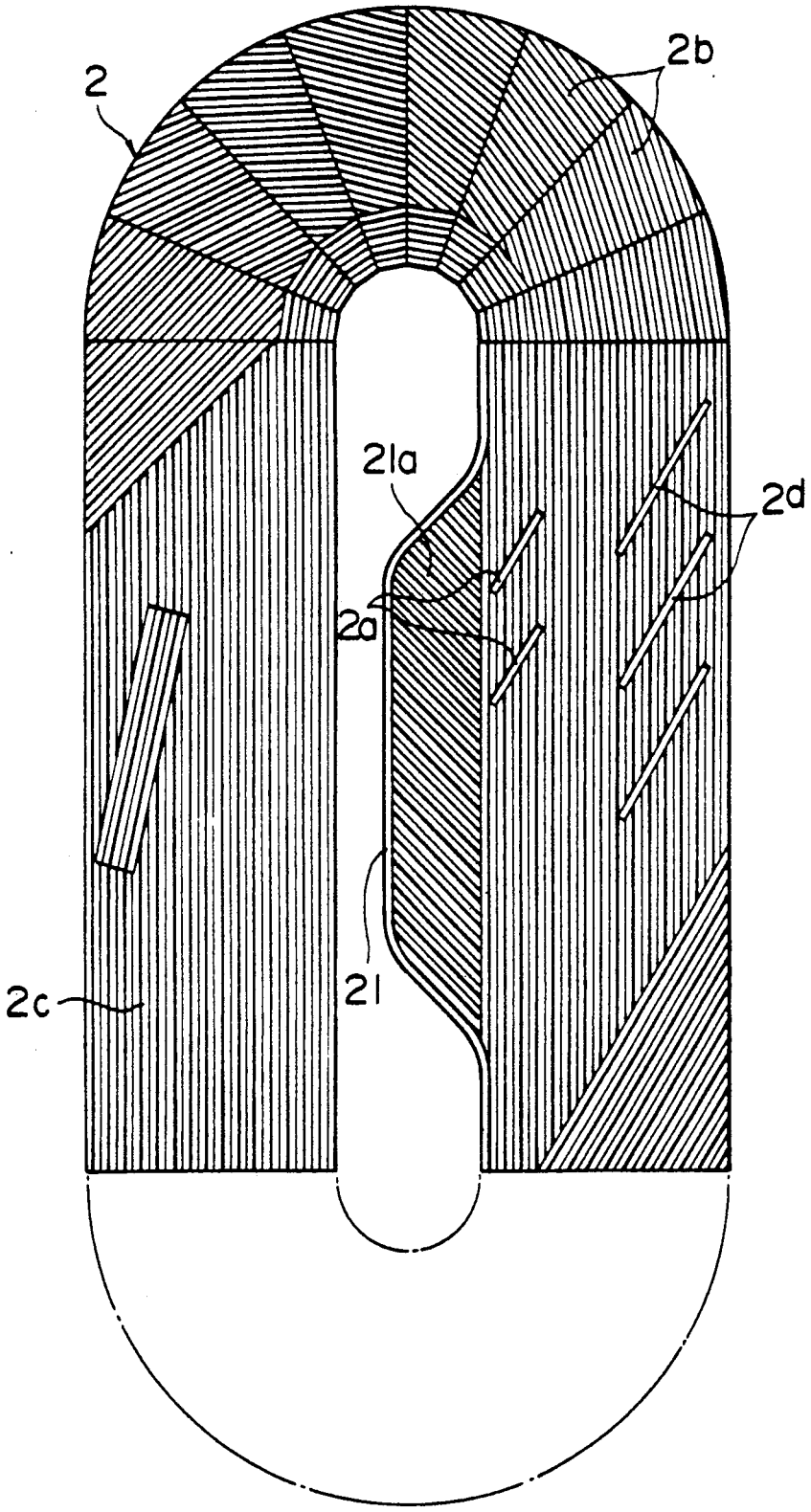
FIG. 4 is a top view of another possible race course using the race track according to this invention.

The embodiment of this invention shown in FIG. 4 includes a pit area 21 formed on a straight portion of the course of race track 1. Inclined entry grooves 2*a*, which are oriented towards pit area 21, are formed in a portion of the course ahead of the pit area 21 so that a racing toy on the straight portion of the course may enter the pit area 21. Return grooves 21*a* are also formed in pit area 21 for returning the racing toy to the course once exit from the pit area 21 is desired.

The shape of the grooves 2*b* in the curved portions of the course are somewhat different from those described above in relation to FIG. 3. More specifically, although the inclined grooves 1*b* of the FIG. 3 embodiment are in shape of continuous arcs, the grooves 2*b* in the embodiment shown in FIG. 4 are segmented. That is, each portion of the grooves 2*b* is divided into separate discrete segments with each segment having a different angle of inclination at which the grooves run from the outside toward the inside of the curves. The straight grooves 2*c* are the same as the grooves 1*a* in FIG. 3. The track 2 shown in FIG. 4 further includes lane-change grooves 2*d* to allow a racing toy traveling along the outside of the course to change lanes and travel along the inside of the course.

The racing toy which is adapted to travel on the exemplary race tracks 1 and 2 shown in FIGS. 3 and 4 below with reference to FIGS. 5*a*–5*b* and FIG. 6. 5*a* and 5*b* includes a motor 3*a* which selectively drives the rear wheels 3*b* in forward and backward rotation directions, the rotation being controllably changed by means of a signal from a remote controller. A steering rod 3*d* controls the orientation of front wheels 3*c*. A mobile arm 3*e* has one end which is connected to the body of the racing toy 3 via a pivot pin $3e_1$ and a middle portion which is connected operably to the steering rod 3*d* via a pivot pin $3e_2$. As such, pivotal movement of the mobile arm 3*e* causes the front wheels to turn due to the operative connection between the mobile arm 3*e* and the steering rod 3*d*. A guide brush 3*f* which is in the form of a bundle of flexible fibers (such as nylon fibers or nylon fishing-type line) is dependently attached to the bottom of the forward end of the mobile arm 3*e* so that the brush 3*f* extends downwardly below the front wheels 3*c*.

As indicated in FIG. 5*b*, the steering rod 3*d* may also be formed into a single unit with the mobile arm 3*e*.

The racing toy 3' shown in FIG. 7 is similar to the toy 3 shown in FIG. 5*a* with the principal exceptions being that the front wheels 3*c*' are driven by motor 3*a*', while the rear wheels 3*b*' are steerable. In this regard, the mobile arm 3*e*' is connected operably to a pivotal follower arm 3*g*' by means of a connecting rod 3*h*'. The rear follower 3*g*' is connected to the steering rod 3*d*' which is coupled to the rear wheels 3*b*'. Thus, pivotal movements of the mobile arm 3*e*' (which is influenced by the brush 3*f*' will be translated into turning movements of the rear wheels 3*b*' due to the linkage provided the connecting rod 3*h*', follower arm 3*g*' and steering rod 3*d*'.

The operation of this invention will be described using the racing toy 3 shown in FIG. 5*a* as an example. In this connection, the racing toy 3 is placed on the race course so that its brush 3*f* is inserted into a straight groove 1*a* or 2*c* of race track 1 or 2, respectively. When the remote controller (not shown) is operated to rotate motor 3*a* in a forward direction with the toy in this state, the driven rear wheels 3*b* rotate and the racing toy 3 moves forward following the straight grooves 1*a* or 2*c*. The front wheels 3*c* are controlled via the steering rod 3*d*, but when the brush 3*f* is guided by straight grooves 1*a* or 2*c* the front wheels 3*c* will likewise follow a straight course. When racing toy 3 moves forward so as to reach one of the inclined grooves 1*b* or segmented grooves 2*b*, the brush 3*f* is then guided by one of the grooves 1*b* or 2*b* as a result of its physically moving thereinto which consequently determines the steering direction of front wheels 3*c* resulting from steering rod 3*d* being turned.

At this point, the speed of racing toy 3 determines which one of grooves 1*b* or 2*b* that the brush 3*f* physically enters. In other words, when the racing toy 3 leaves one of the straight grooves 1*a* or 2*c*, it will slide over the irregular surfaces of grooves 1*b* or 2*b*. Racing toy 3 then turns so that steering lever 3*d* directs the front wheels 3*c* towards the inside according to the degree of frictional resistance when the brush 3*f* slides over the irregular surfaces of the grooves 1*b* or 2*b*. The amount of turning movement exhibited by the wheels 3*c* is relatively small when the speed of racing toy 3 is high, and is relatively large when the speed of racing toy 3 is low. Thus, when the speed of the racing toy 3 is high, it travels towards the outside of the curve, and when the speed of racing toy 3 is low, it travels towards the inside of the curve. Consequently, when an operator desires to move the toy 3 tightly around a curve, the speed of the racing toy 3 should be lowered thereby allowing the racing toy 3 to be driven in a more realistic manner.

When a pit stop is desired using the track shown in FIG. 4, the speed of racing toy 3 is reduced upon reaching the entry grooves 2*a* formed in a portion of straight grooves 2*c*. As a result, the brush 3*f* enters the grooves 2*a* which results in the racing toy 3 being guided into the pit area 21. When returning, the racing toy 3 is guided back onto the course from pit area 21, by being moved forward at a relatively low speed with the brush 3*f* being guided by the return grooves 21*a*. Upon reaching the course, the brush 3*f* is once again guided by straight grooves 2*c* on the course which results in the racing toy 3 being guided back onto the straight portion of the course. In such a manner, it is possible to continue racing.

Since the brush 3*f* is formed by a bundle of flexible fibers (such as nylon fibers or nylon fishing line) as previously described, and since the brush 3*f* is accurately guided within the grooves, when the brush 3*f* comes out of a groove, it is possible to go around curves by proper movement of steering lever 3*d* as a result of the frictional resistance between the brush 3*f* and the irregular surfaces which are formed as a result of the presence of the grooves.

The present invention thus relates to a track in which a plurality of grooves are formed so as to guide a brush attached to a steering lever of a racing toy. The racing toy is allowed to move around the outside or inside of curves along the track in dependence upon its speed as a result of frictional resistance between the brush and the grooves on curved portions of said course. As a result, more realistic racing sensations are achieved. Moreover, since it is possible to allow the racing toy to make pit stops in pit areas formed on the course solely by controlling the speed of said racing toy, the present invention also has the benefit of allowing an operator to have racing strategies in the manner of an actual automobile race. The guide brush formed of a bundle of flexible fibers enables good contact to be made with the irregular surfaces of the grooves thus allowing accurate steering around curves. Therefore, the present invention enables the racing toy to be driven around the course in a variable manner as desired by the operator.

We claim:

1. A toy racing set comprising an endless track, and a remote-controlled self-propelled wireless racing toy which is adapted to travel around the track in a predetermined direction, wherein said track includes;

a number of curved and straight sections connected to one another in such a manner as to establish a desired closed-loop race course, said straight sections including a plurality of linear grooves extending generally parallel to the travel direction of the racing toy, and said curved sections including a plurality of discontinuous turning grooves which are oriented at an angle from an outside portion of the curved section towards an inside portion of the curved section with respect to the predetermined travel direction of the racing toy as the racing toy enters the curved section from an adjacent straight section; and wherein said racing toy includes;

front and rear pairs of wheels for supporting the toy for rolling movement along said track, a remote-controlled motor for driving at least one of said front and rear pairs of wheels, at least the other of said front and rear pair of wheels being steerably turnable and having a mobile arm and a downwardly extending guide brush member connected to said mobile arm and adapted to being guided within one of the grooves as the racing toy travels around the track, and wherein frictional engagement between said brush and said angled turning grooves varies in response to speed of the racing toy such that at a relatively high speed of travel in said predetermined direction the brush slides over the discontinuous angled turning grooves whereby no turning movement is imparted to the racing toy, but at relatively low speed of travel the brush is engaged within and follows one of the angled turning grooves whereby turning movement is imparted to the racing toy.

2. A toy racing set as in claim 1, wherein said discontinuous angled turning grooves arcuately extend around at least a portion of said curved section.

3. A toy racing set as in claim 1, wherein said plurality of discontinuous angled turning grooves form segments of the curved section such that the angle of inclination of sequential segments increases towards the inside of the curved section relative to the travel direction of the racing toy around the curved section.

4. A toy racing set as in claim 1, 2, or 3, wherein at least one of said straight segments includes a laterally adjacent pit area for the racing toy, and wherein upstream of said pit area said straight section is provided with a number of entry grooves which are inclined toward said pit area relative to the travel direction of said racing toy.

5. A toy racing set as in claim 4, wherein said pit area includes return grooves which are inclined towards said at least one straight section relative to the travel direction of said racing toy.

6. A toy racing set as in claim 1, wherein the angled grooves have a rectangular, serrated or circular cross-sectional configurations.

7. A track for a toy racing set upon which a remote-controlled self-propelled wireless racing toy having a steerable set of wheels and a guide brush travels in a predetermined direction, said track comprising:

a number of curved and straight sections connected to one another so as to establish a closed-loop race course of desired configuration, said straight sections including a plurality of linear grooves extending generally parallel to the travel direction of the racing toy, and said curved sections including a plurality of discontinuous turning grooves which are oriented at an angle from an outside portion of the curved section towards an inside portion of the curved section with respect to the predetermined travel direction of the racing toy as the racing toy enters the curved section from an adjacent straight section, wherein frictional engagement between the guide brush and said angled turning grooves varies in response to speed of the racing toy such that at a relatively low speed the guide brush slides over the discontinuous angled turning grooves whereby no turning movement is imparted to the racing toy, but at relatively low speed of travel the guide brush is engaged within and follows one of the angled turning grooves, whereby turning movement is imparted to the racing toy.

8. A track as in claim 7, wherein said discontinuous angled turned grooves arcuately extend around at least a portion of said curved section.

9. A track as in claim 7, wherein said plurality of discontinuous angled turning grooves form segments of the curved section such that the angle of inclination of sequential segments increases towards the inside of the curved section relative to the travel direction of the racing toy around the curved section.

10. A track as in claim 7, 8 or 9 wherein at least one of said straight segments includes a laterally adjacent pit area for the racing toy, and wherein upstream of said pit area said straight section is provided with a number of entry grooves which are inclined toward said pit area relative to the travel direction of said racing toy.

11. A track as in claim 10, wherein said pit area includes return grooves which are inclined towards said at least one straight section relative to the travel direction of said racing toy.

12. A racing toy adapted to following a track having curved sections which include a plurality of discontinuous angled turning grooves oriented at an angle with respect to a predetermined travel direction of the racing toy around the track as the racing toy enters the curved section from an adjacent straight section, the racing toy comprising:

front and rear pairs of wheels for supporting the toy for rolling movement along said track;

a remote-controlled motor for driving at least one of said front and rear pairs of wheels;

at least the other of said front and rear pair of wheels being steerably turnable and having a mobile arm and a downwardly extending guide brush member formed of a bundle of fiber elements which is connected to said mobile arm and adapted to being guided within one of the grooves as the racing toy travels around the track; and wherein frictional engagement between said guide brush and the discontinuous angled turning grooves varies in response to speed of the racing toy such that at a relatively high speed of travel in said predetermined direction the brush slides over the discontinuous angled turning grooves whereby no turning movement is imparted to the racing toy, but at relatively low speed of travel the brush is engaged within and follows one of the discontinuous angled turning grooves whereby turning movement is imparted to the racing toy.

13. A racing toy as in claim 12, wherein the bundle of fibers of said guide brush are formed of nylon fibers.

14. A racing toy as in claim 12, wherein the front pair of wheels are steerable and the rear pair of wheels are driven by said motor.

15. A racing toy as in claim 12, wherein the rear pair of wheels are steerable and the front pair of wheels are driven by said motor, and wherein the racing toy includes a rear pivotal arm, a connecting rod connecting interconnected between said mobile and said rear arms, wherein said steering rod is connected between the rear pair of wheels and is pivotally coupled to said rear arm.

16. A racing toy as in claim 12, wherein said steering arm is pivotally coupled to said mobile arm.

17. A racing toy as in claim 12, wherein said mobile arm and said steering rod are formed as a one-piece unit.

* * * * *